US006607180B1

(12) United States Patent
Zak

(10) Patent No.: US 6,607,180 B1
(45) Date of Patent: Aug. 19, 2003

(54) MULTI-PURPOSE VEHICLE TOOL

(75) Inventor: Michael W. Zak, Bayonne, NJ (US)

(73) Assignee: S&G Tool Aid Corp., Newark, NJ (US)

( * ) Notice: Subject to any disclaimer, the term of this patent is extended or adjusted under 35 U.S.C. 154(b) by 0 days.

(21) Appl. No.: 10/161,967

(22) Filed: Jun. 4, 2002

(51) Int. Cl.[7] ..... B66F 3/36

(52) U.S. Cl. ..... 254/100; 254/DIG. 5; 74/532; 74/527; 403/104; 248/354.6

(58) Field of Search ..... 74/532, 482, 481; 70/201, 202, 238; 254/100, 98, 133 R, 133 A, 134, DIG. 4; 269/69

(56) References Cited

U.S. PATENT DOCUMENTS

| | | | | | |
|---|---|---|---|---|---|
| 3,315,539 | A | * | 4/1967 | Solberg | 74/532 |
| 3,866,719 | A | | 2/1975 | Streutker | |
| 3,910,135 | A | * | 10/1975 | Phillips | 74/532 |
| 4,893,413 | A | | 1/1990 | Merrill | |
| 5,087,019 | A | * | 2/1992 | Peabody | 254/100 |
| 5,417,127 | A | * | 5/1995 | Bueti | 74/532 |
| 5,671,620 | A | | 9/1997 | Carvey | |
| 5,765,416 | A | * | 6/1998 | Cote | 70/238 |
| 5,778,709 | A | * | 7/1998 | Hsu | 70/209 |
| 6,131,712 | A | | 10/2000 | Rhodenizer | |
| 6,199,828 | B1 | * | 3/2001 | Komperud | 254/100 |
| 6,279,418 | B1 | * | 8/2001 | Olive | 74/532 |

OTHER PUBLICATIONS

Wheel–A–matic Corporation—brochure AES Industries—brochure.

* cited by examiner

*Primary Examiner*—Joseph J. Hail, III
*Assistant Examiner*—Daniel Shanley
(74) *Attorney, Agent, or Firm*—Harold James; Robert L. Epstein; James & Franklin, LLP

(57) ABSTRACT

The present invention relates to a multi-purpose tool for use in connection with vehicle adjustments and repairs when it is required, in the course of repair or maintenance work, that the steering wheel, brake pedal or accelerator pedal (or clutch pedal, if present) be placed and retained in a particular position while appropriate work is performed. The tool comprises a plurality of parts selectively assemblable to carry out the desired one of a number of possible procedures.

10 Claims, 3 Drawing Sheets

FIG. 4
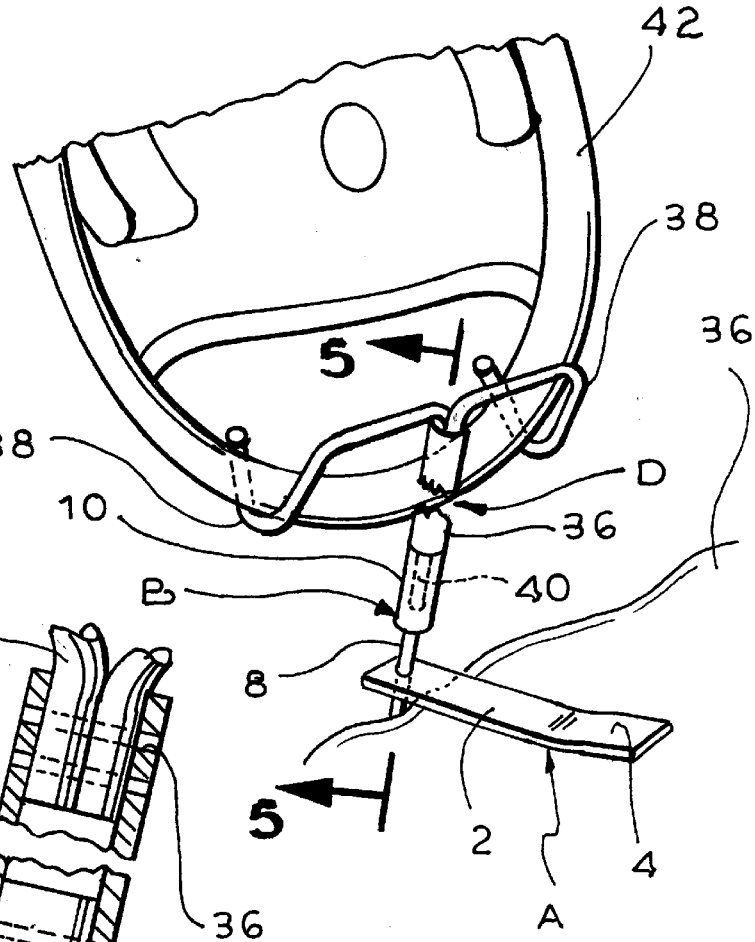
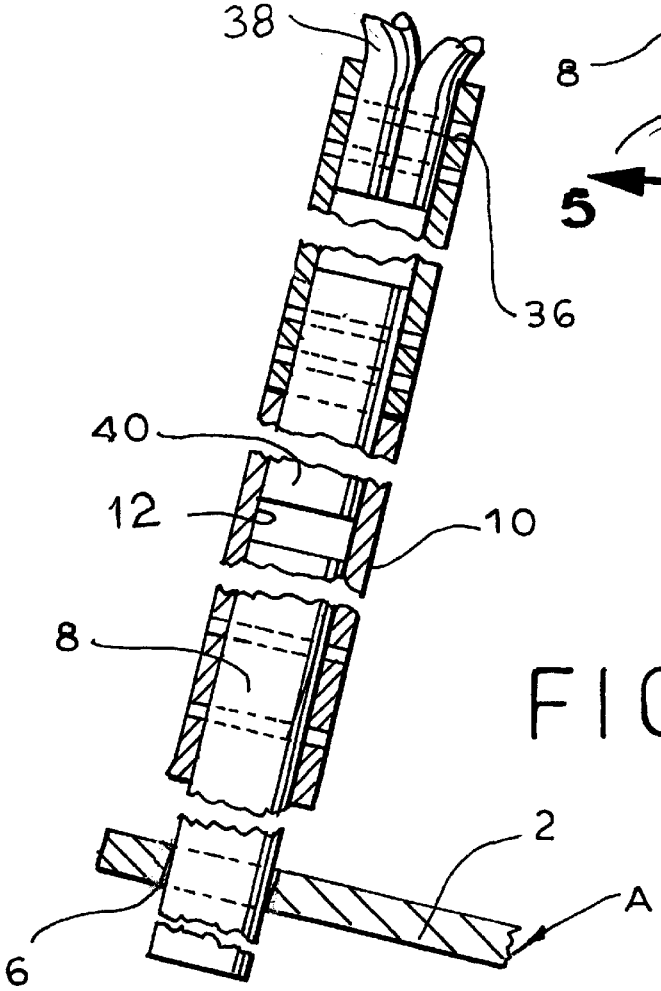
FIG. 5

MULTI-PURPOSE VEHICLE TOOL

MULTI-PURPOSE VEHICLE TOOL

The present invention relates to a tool for use in connection with vehicle adjustment and repair when it is required, in the course of repair or maintenance work, that the steering wheel, brake pedal or accelerator pedal (or clutch pedal, if present) be placed and retained in a particular position while appropriate work is performed.

BACKGROUND OF THE INVENTION

Automotive technicians are often called upon to perform repairs, adjustments or maintenance on various elements of the vehicle which require that a control element of the vehicle, such as the steering wheel, brake pedal or accelerator pedal (or clutch pedal, if present), be retained in a particular position while work is performed. For example, when wheel toe-in, toe-out, centering and alignment must be carried out the steering wheel must be reliably held in a fixed position while the work is being performed. Similarly in wheel alignment procedures, the brake pedal must be depressed and held in the depressed position while appropriate work is carried out. Also, in the course of other operations it is required that the engine be driven to rotate at a particular predetermined speed, which is in turn controlled by the degree to which the accelerator pedal is depressed. While the steering wheel, accelerator, brake and clutch pedal positionings could be carried out by one person while another person performs the necessary adjustments, that is obviously uneconomical, and also undesirable to the extent that it requires skill and concentration on the part of the individual to whom the positioning task is assigned. Consequently, there have been available to the technicians tools each of which can accomplish only one of these results and to less than optimum degree of satisfaction. Tools effective to engage and control the steering wheel, and tools effective to depress either the brake pedal or the accelerator pedal are available on the market, but distinctly separate tools are provided for one purpose or the other, thus adding to the initial cost and inventory storage space of the technicians. In addition, tools available for pedal engagement are functionally inadequate, particularly in connection with accelerator pedal control, since they do not adequately provide for precisely adjustable accelerator positioning, which is necessary if the technician is to readily achieve and maintain the proper engine speed while the adjustment work is in process.

SUMMARY OF THE INVENTION

In accordance with the present invention, a multi-purpose tool is provided which can not only be used more readily than the individual tools previously available for performing repair and maintenance work which involves the accurate positioning of the steering wheel, the brake pedal, or the accelerator pedal, but in addition constitutes a multi-purpose tool which supplants the plurality of operatively separately functioning tools previously available. Thus the inventory that must be carried by a technician is minimized, leading to reduction in costs and more ready tool availability, and also enabling the requisite repair or maintenance operation to be carried out accurately and reliably.

To that end, the multi-purpose tool of the present invention comprises a structure adapted to engage and extend from the front seat of a vehicle, to which structure one can selectively apply a pedal-positioning element or a steering-wheel-holding element. In its preferred form that structure may provide for relatively rough adjustable positioning of the element attached thereto. That rough adjustment may well be adequate for the positioning of the steering-wheel-holding element, which often can perform its desired function without requiring precise positioning. However, when pedal positioning is involved, and particularly positioning of the accelerator pedal, such rough adjustment may not be adequate. In certain repair operations it is required that the engine be operated at a particular speed, and to accomplish that result the accelerator pedal must be depressed only to a corresponding degree. To obtain precision positioning of the accelerator pedal has been a problem even with prior art tools specifically designed for that purpose. Moreover, if the maintenance operation in process involves an appreciable period of time, as is often the case, it may be necessary to periodically precisely adjust the degree to which the accelerator pedal is depressed to take into account changing engine conditions. Accordingly, in accordance with the present invention, the element of the multi-purpose tool here disclosed which is designed to engage and position the accelerator pedal is itself so constructed that its effective length, and hence the adjusted position of the accelerator pedal, may be precisely altered in one direction or the other while the tool is in place, thus giving the technician the ability to carry out the required maintenance or repair operation in an optimum fashion. That precision adjustment of the length of the pedal-engaging element is best achieved, in the preferred form here disclosed, by having the element formed of two threadedly engaged parts, one of which parts rotatably connects to the seat-engaging structure, so that length adjustment can be achieved without removing the tool from its active position.

Thus the present invention provides for convenience, ready accessibility and low cost, while at the same time providing for improved functioning and control.

To the above objects, and to such other objects as may hereinafter appear, the present invention relates to a multi-purpose vehicle repair and adjustment tool as defined in the following claims, taken together with the accompanying drawings.

BRIEF DESCRIPTION OF THE DRAWINGS

FIG. 4 is a three-dimensional view showing the tool in use as a steering wheel retainer; and FIG. 5 is a cross-sectional view taken along the lines 5—5 of FIG. 4.

DESCRIPTION OF THE PREFERRED EMBODIMENT

Figure 1:
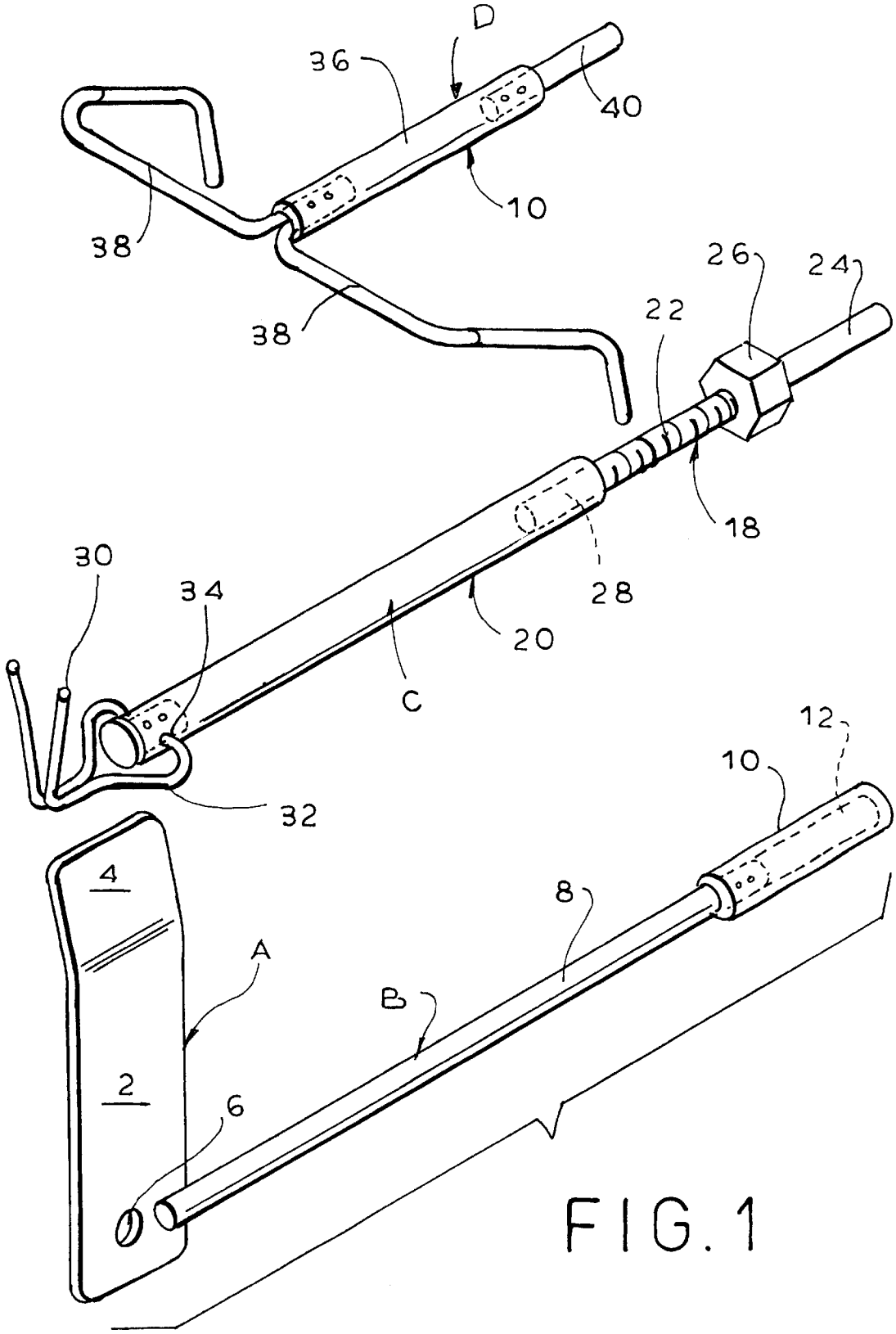
FIG. 1 is a three-quarter perspective view of the four elements of the tool of the present invention—the wheel-engaging element, the pedal-engaging element, and the seat-engaging structure, which comprises a plate-like element with its associated adjustably positionable projecting element therebelow.

The multi-purpose tool of the present invention in its preferred form here specifically disclosed comprises four elements individually shown in FIG. 1.

The first element, generally designated A, is designed to engage the front seat of a vehicle and to support the remainder of the tool in operative position. It is preferably in the form of an elongated relatively rigid plate 2 one end 4 of which is slightly inclined relative to the remainder of the plate 2, the latter being provided opposite the end 4 with an aperture 6.

Figure 3:
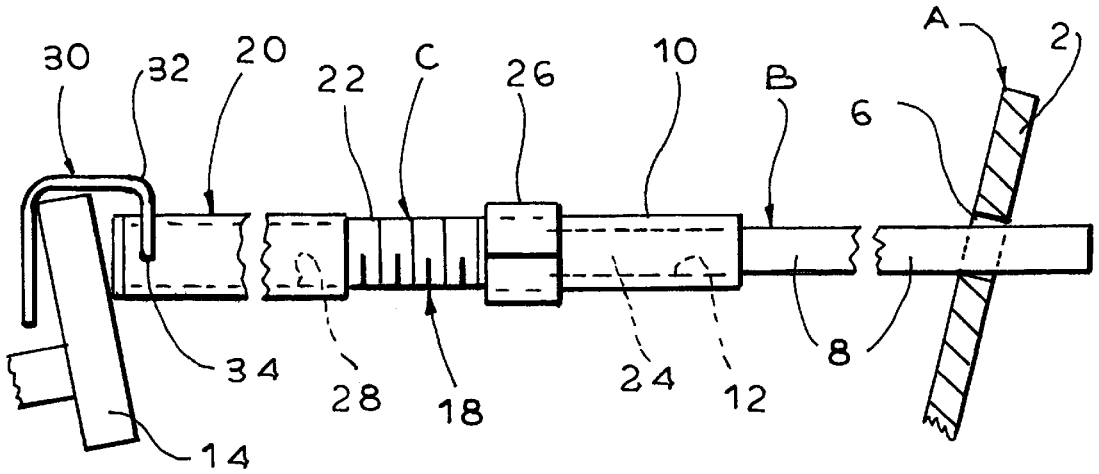
FIG. 3 is an enlarged elevational view of the tool shown in FIG. 2.

The second element, generally designated B, is designed to be adjustably associated with the element A. It comprises an elongated rod 8 sized to pass through the aperture 6 with some clearance, so that when the rod 8 is perpendicular to the plate 2 it can slide freely through the aperture 6, but when it is inclined relative thereto, as shown in FIGS. 3 and 5, it engages the edges of the aperture 6 and is retained in position thereby. At the end of the rod 8 opposite from the end which passes through the aperture 6 is an enlarged cylindrical portion 10 defining a socket 12 open at its extended end.

The third element C is designed to be used to engage and position either the accelerator pedal 14 or the brake pedal 16 of the vehicle (or the clutch pedal, if present). It is in two parts generally designated 18 and 20 respectively. The part 18 comprises an externally threaded portion 22 at one end, a rod-like portion 24 at its other end, and an enlarged portion 26 between the portions 22 and 24. The part 20 is in the form of a rod with an inwardly extending internally threaded socket 28 at one end into which the portion 22 of part 18 is threadedly received. At the other end of the rod 20 is a pedal-engaging part generally designated 30 and here shown in the form of a fork 32 pivotally mounted at 34 on the end of the rod 20.

The fourth element D comprises a rod 36 which at one end preferably carries a fork 38 designed to engage the rim of a steering wheel. Its other end is constituted by a rod 40 adapted to be received in the socket 12 of the element B.

Figure 2:
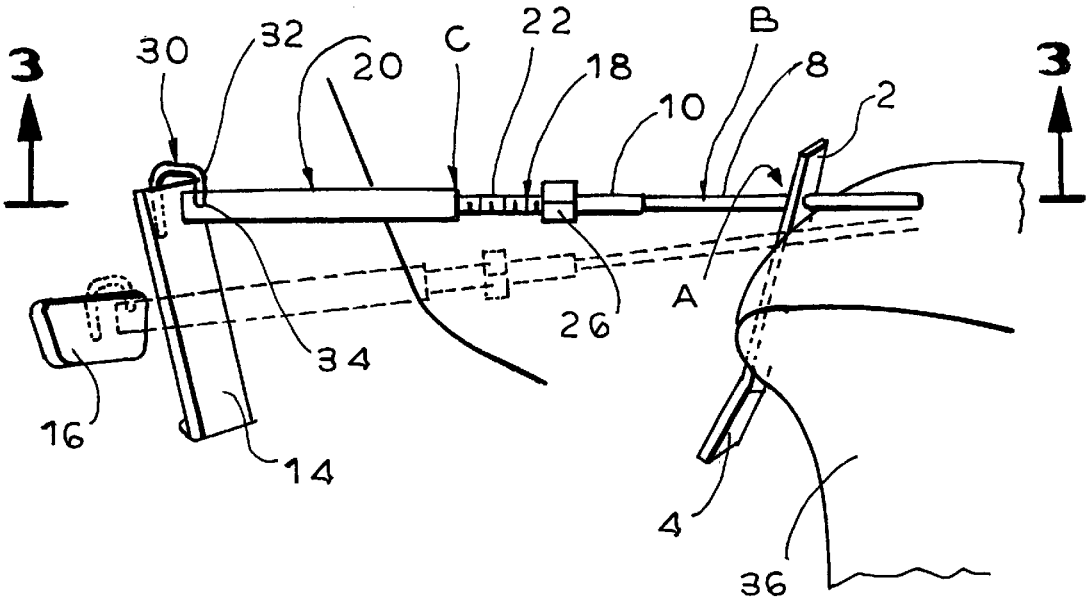
FIG. 2 shows the tool in use as a pedal-engaging device—the tool being shown in solid lines engaging the vehicle accelerator pedal and in broken lines engaging the vehicle brake pedal.

FIGS. 2 and 3 illustrate how the tool of the present invention can be used to accurately position an accelerator pedal 14 or brake pedal 16 (or the clutch pedal, if present). The element A is positioned vertically against the front edge of the front seat 36 of the vehicle with the inclined portion 4 of the plate 2 being oriented downwardly and with the aperture 6 of the plate 2 being located above the upper surface of the seat 36. The rod 8 of the element B is passed through the aperture 6, to desired degree, extends over the upper surface of the seat 36, and is oriented toward the pedal 14 or 16 while being oriented in a non-perpendicular position relative to the plate 2, thus retaining the elements A and B in relative position. The element C is then associated with the element B by passing the part 24 of the element C into the socket 12 of the element B and by hooking the hooks 32 over the top of the accelerator pedal 14. As has been pointed out, positioning of the element B and hence the element C is accomplished by sliding the rod 8 through the aperture 6 to the desired degree while the rod 8 is generally perpendicular to the plate 2, the orientation of the element A to the element B to permit that adjustment being readily accomplished by grasping and appropriately moving the inclined portion 4 of the plate 2. Thereafter the precise positioning of the accelerator pedal 14 is accomplished by grasping the enlarged portion 26 of the part 18 and rotating it in one direction or the other so as to extend or shorten the overall length of the element and thus appropriately position the accelerator pedal 14. Rotation of the element 18 is facilitated when the enlarged portion 26 is rendered readily graspable, as by being knurled or, as here specifically disclosed, being provided with flats.

Length adjustment of the tool by changing the relative positions of the elements A and B facilitates gross length control and rotation of the part 18 relative to the part 20 produces precision length control by utilizing threading of appropriate precision. This description also applies to use of the tool for positioning the brake pedal 16 (or clutch pedal, if present).

When it is required that the steering wheel of the vehicle be retained in a particular position the steering wheel, such as that shown in FIG. 4 and identified by the number 42, is turned to the position appropriate to the particular operation being performed. The elements A and B are associated with one another, but this time the element A is generally horizontal, with the plate 2 located on the upper surface of the front seat 36, with its inclined portion 4 extending somewhat upwardly away from the seat. The element B extends generally upwardly from the element A with its socket 12 open at its upper end. The element D is connected to the element B by sliding the rod 42 into the socket 12. Since the hooks 38 of the element D extend upwardly, one way that the tool can be placed in its steering-wheel-engaging condition is by assembling the elements B and D, vertically positioning the assembly so that the hooks 38 engage the steering wheel 40, sliding the element A up along the rod 8 while the element A is swung out of the way of the vehicle seat 36 until the element A is slightly above the upper surface of the seat, then swinging the element A to overlie the seat 36, making final adjustments of the rod 8 with respect to the flat plate 2 to ensure firm engagement of the hooks 38 with the steering wheel 40, and then inclining the flat plate 2 relative to the rod 8 while the flat plate 2 rests on the upper surface of the seat 36, thereby to hold all of the parts in position.

From this it will be appreciated that the tool of the present invention is made up of relatively simple and inexpensive parts to constitute a single multi-purpose tool readily and accurately useable by the technicians to perform a variety of adjustment procedures, thus taking the place of an equal plurality of individual tools while providing for more accurate and readily achievable control than has been possible heretofore with the individual tools.

While only a single embodiment of the present invention has been here disclosed it will be apparent that many variations may be made in the details thereof, all within the scope of the instant invention as defined in the following claims.

I claim:

1. A multi-purpose vehicle repair tool for a vehicle having a front seat, a steering.wheel and an accelerator or similar pedal comprising a first element adapted to engage the front seat of a vehicle and having an aperture therethrough, a second longitudinally extending element one end of which is slidably adjustably receivable in said aperture and having an end remote from said first element with a socket formed thereon and, selectively in combination therewith, third and fourth elements for engaging the accelerator or similar pedal and the steering wheel of said vehicle respectively, each of said third and fourth elements having adjacent one end a part removably receivable in the socket of said second element and having adjacent its other end means for engaging the accelerator or similar pedal and steering wheel, respectively, of said vehicle.

2. In combination with the tool of claim 1, means for adjusting the length of said third element.

3. The tool of claim 2, in which said second element engages said aperture to fix the relative positions of said first and second elements, thereby to provide coarse adjustments of the overall length of said tool, and in which said third element comprises first and second sections threadedly engaged with one another and being relatively rotatable while said third element is engaged at one end with said second element and at its other end with the vehicle's accelerator or similar pedal, thereby to provide fine adjustment of the overall length of said tool.

4. The tool as in any of claims 1–3, in which said third element comprises a hook pivotally mounted adjacent the pedal-engaging-end of said element and adapted to hook over the vehicle's pedal.

5. The tool as in any of claims 1–3, in which said third element comprises two longitudinally extending parts, the first part being adapted to engage adjacent one end the vehicle's pedal and provided adjacent its other end with a threaded portion, the second part having at one end a threaded portion engagable with the threaded portion of the first part, having at its other end a part receivable in the socket of said second element, and having a manually accessible portion between said first and second parts, said manually accessible portion being adapted to be grasped and rotated, thereby to produce relative motion in the threaded portions which results in a change in effective length of said third element while said second and third element s are in position between said first element and said vehicle pedal.

6. The tool of claim 5, in which said manually accessible portion is of greater diameter than said first and second parts and has a radially outer surface with flats to facilitate its manual rotation.

7. The tool as in any of claims 1–3, in which said aperture in said first element is located adjacent to one end of said first element and in which an end portion of said first element remote from said aperture is inclined relative to the remainder of said element.

8. A vehicle repair tool comprising a flat element adapted to be pressed against the seat cushion of a vehicle and having a portion projecting therebeyond, the thus projecting portion having an aperture therethrough, an elongated second element one end of which is slidably receivable through said aperture and adapted to engage an edge of said aperture so that the position of said second element relative to said first element can roughly be adjusted and fixed, thereby to provide rough adjustment of the overall length of said tool, said second element having a socket remote from said first element, and a third element comprising first and second relatively axially moveable parts, thereby to provide fine adjustment of the overall length of said tool, the first of said parts having an element removably receivable in said socket of said second part, the second of said parts carrying, remote from said first part, means for engaging a vehicle pedal.

9. The tool of claim 8, in which the first and second parts of said third element are threadedly engaged and relatively rotatable, whereby relative rotation of said parts produces a change in the effective length of said third element.

10. The tool of either of claims 8 or 9, in which said aperture in said first element is located adjacent to one end of said first element and in which an end portion of said first element remote from said aperture is inclined relative to the remainder of said element.

* * * * *

UNITED STATES PATENT AND TRADEMARK OFFICE

CERTIFICATE OF CORRECTION

PATENT NO. : 6,607,180 B1
DATED : August 19, 2003
INVENTOR(S) : Zak et al.

It is certified that error appears in the above-identified patent and that said Letters Patent is hereby corrected as shown below:

Title page,
Item [75], Inventors, add
-- Timothy Craig Simmons --.

Signed and Sealed this

Twenty-third Day of December, 2003

JAMES E. ROGAN
*Director of the United States Patent and Trademark Office*